US007395812B2

(12) United States Patent
Ricco et al.

(10) Patent No.: US 7,395,812 B2
(45) Date of Patent: Jul. 8, 2008

(54) FUEL-INJECTION SYSTEM FOR AN INTERNAL-COMBUSTION ENGINE

(75) Inventors: Mario Ricco, Casamassima (IT); Adriano Gorgoglione, Valenzano (IT); Raffaele Ricco, Valenzano (IT); Sergio Stucchi, Valenzano (IT)

(73) Assignee: C.R.F. Societa Consortile per Azioni (IT)

( * ) Notice: Subject to any disclaimer, the term of this patent is extended or adjusted under 35 U.S.C. 154(b) by 19 days.

(21) Appl. No.: 11/617,629

(22) Filed: Dec. 28, 2006

(65) Prior Publication Data

US 2007/0283928 A1 Dec. 13, 2007

(30) Foreign Application Priority Data

Jun. 9, 2006 (EP) ..... 06425394

(51) Int. Cl.
*F02M 63/00* (2006.01)
*F02M 37/04* (2006.01)

(52) U.S. Cl. ..... 123/446; 123/447; 123/496

(58) Field of Classification Search ..... 123/446, 123/447, 496, 458; 417/298
See application file for complete search history.

(56) References Cited

U.S. PATENT DOCUMENTS 4,884,545 A * 12/1989 Mathis ..... 123/447
5,538,403 A * 7/1996 Black ..... 417/253
5,577,892 A * 11/1996 Schittler et al. ..... 417/53
5,884,606 A * 3/1999 Kellner et al. ..... 123/446
6,045,120 A * 4/2000 Tarr et al. ..... 251/282
6,116,870 A * 9/2000 Kraemer ..... 417/490
6,345,608 B1 * 2/2002 Rembold et al. ..... 123/506
6,408,824 B1 * 6/2002 Pacucci et al. ..... 123/467
6,526,947 B2 * 3/2003 Shimada et al. ..... 123/495
6,546,918 B2 * 4/2003 Onishi et al. ..... 123/506
6,554,590 B2 * 4/2003 Maeda et al. ..... 417/505
6,568,927 B1 * 5/2003 Guentert ..... 417/569
6,581,577 B1 * 6/2003 Geyer ..... 123/514
6,651,630 B2 * 11/2003 Hiraku et al. ..... 123/506
6,701,898 B2 * 3/2004 Tokuo et al. ..... 123/456
6,832,748 B2 * 12/2004 Carroll et al. ..... 251/30.01

(Continued)

FOREIGN PATENT DOCUMENTS

EP 1 195 514 4/2002

(Continued)

OTHER PUBLICATIONS

European Search Report dated Nov. 13, 2006.

*Primary Examiner*—Thomas N Moulis
(74) *Attorney, Agent, or Firm*—Ostrolenk, Faber, Gerb & Soffen, LLP

(57) ABSTRACT

The injection system comprises a high-pressure pump (7) with variable flowrate, having a number of pumping elements (18) actuated with reciprocating motion and provided each with a corresponding intake valve (22). An accumulation volume (28) is supplied with fuel at low pressure from an intake pipe (10) of the pump (7) through a solenoid valve (31) controlled as a function of the operating conditions of the engine (2). The accumulation volume (28) is in communication with the intake valves (22) through corresponding outlet holes (29), and the solenoid valve (31) is provided with nebulizer holes (36) such as to generate corresponding jets of fuel, each directed towards at least one of said outlet holes (29).

18 Claims, 3 Drawing Sheets

U.S. PATENT DOCUMENTS

| | | | | |
|---|---|---|---|---|
| 6,886,536 | B2 * | 5/2005 | Ranaldo et al. | 123/456 |
| 6,895,936 | B2 * | 5/2005 | Kuroda | 123/446 |
| 6,899,083 | B2 * | 5/2005 | Djordjevic | 123/446 |
| 6,966,300 | B2 * | 11/2005 | Fukuda | 123/446 |
| 6,976,473 | B2 * | 12/2005 | Boos et al. | 123/446 |
| 7,198,034 | B2 * | 4/2007 | Ausiello et al. | 123/506 |
| 7,240,666 | B2 * | 7/2007 | Okamoto | 123/446 |
| 7,263,979 | B2 * | 9/2007 | Ricco et al. | 123/500 |
| 7,325,536 | B2 * | 2/2008 | Okamoto | 123/446 |
| 2001/0006061 | A1 * | 7/2001 | Shimada et al. | 123/495 |
| 2003/0059322 | A1 * | 3/2003 | Hiraku et al. | 417/505 |
| 2004/0000289 | A1 * | 1/2004 | Seo et al. | 123/447 |
| 2004/0200456 | A1 * | 10/2004 | Eser et al. | 123/458 |
| 2006/0104826 | A1 * | 5/2006 | Ricco et al. | 417/244 |
| 2007/0079810 | A1 * | 4/2007 | Usui et al. | 123/467 |

FOREIGN PATENT DOCUMENTS

| | | |
|---|---|---|
| EP | 1 298 316 | 4/2003 |
| EP | 1 469 190 | 10/2004 |
| FR | 2 845 132 | 4/2004 |

* cited by examiner

FUEL-INJECTION SYSTEM FOR AN INTERNAL-COMBUSTION ENGINE

The present invention relates to a fuel-injection system for an internal-combustion engine.

As is known, in modern internal-combustion engines, for example diesel engines, the high-pressure pump of the injection system is designed to send fuel to a common rail for the fuel under pressure to supply a plurality of injectors associated to the cylinders of the engine. The pressure of the fuel required in the accumulation volume for this type of systems is in general defined by an electronic control unit as a function of the operating conditions of the engine.

Injection systems are known in which a by-pass solenoid valve, set on the delivery pipe of the pump, is controlled by the control unit for discharging the fuel pumped in excess directly into the usual fuel tank before it enters the common rail, dissipating in the form of heat a part of the compression energy of the high-pressure pump.

There have also been proposed injection systems in which the high-pressure pump presents a variable flowrate in order to reduce the amount of fuel pumped when the engine operates at a reduced power.

In one of these systems, the intake pipe of the pump is provided with a device for regulating the flowrate, comprising a restriction with step less varying cross section, controlled by the electronic control unit as a function of the pressure required in the common rail and/or of the operating condition of the engine. In said system, the device for regulating the flowrate is supplied with a constant pressure of approximately 5 bar, supplied by an auxiliary pump. By step less varying the effective area of passage and introducing a pressure drop, the amount taken in by the pumping elements hydraulically connected thereto is modulated.

Unfortunately, at low flowrates, the pressure of the fuel in the volume downstream of the regulating solenoid valve and upstream of the intake valves is relatively low and consequently contributes only to a small extent to the force for opening the intake valves themselves. In this type of systems, the usual return spring of the intake valve must thus be such as to guarantee opening thereof even with a minimum pressure close to zero in said volume. On the one hand, said spring must be calibrated in a very precise way, so that the pump is relatively costly. On the other hand, there is always the risk that the negative pressure caused by the pumping element in the compression chamber is not sufficient to bring about opening of the intake valve, so that the pump does not operate properly and is subject to deteriorate easily. In either case, if the pump has a number of pumping elements, it always gives rise to asymmetrical deliveries, which generate mutual perturbations, known as "cross talk".

In another known injection system, it has been proposed to provide, on the intake pipe of the high-pressure pump, a shut-off solenoid valve, which, by introducing a small pressure drop, enables a relatively high flowrate such as to supply the pumping element with the maximum pressure possible during a variable part of the intake stroke, the instant of end of supply of which is modulated. This known injection system needs to synchronize actuation of the solenoid valve with the position of the piston of the pumping element during the intake stroke. Also in the case of mechanical transmission of the motion between the driving shaft and the shaft for actuating the pump said synchronization is difficult, also because the intake of the fuel by the injector occurs with a phase that varies as a function of the operating condition of the engine.

The aim of the invention is to provide a fuel-injection system, comprising a high-pressure pump having a variable flowrate, such that it will present a high degree of reliability and a limited cost, eliminating the drawbacks of the fuel-injection systems of the known art.

According to the invention, the above aim is achieved by a fuel-injection system for an internal-combustion engine, comprising a high-pressure pump having a variable flowrate, as defined in Claim 1.

In particular, an accumulation volume for fuel at low pressure has outlet holes in communication with the intake valves of the pumping elements, this accumulation volume being supplied through a solenoid valve designed to generate jets of fuel directed towards at least one corresponding outlet hole, the solenoid valve being controlled asynchronously with respect to the intake strokes of the pumping elements as a function of the operating conditions of the engine.

For a better understanding of the invention, a preferred embodiment is described herein, purely by way of example and with the aid of the attached drawings, wherein.

Figure 1:
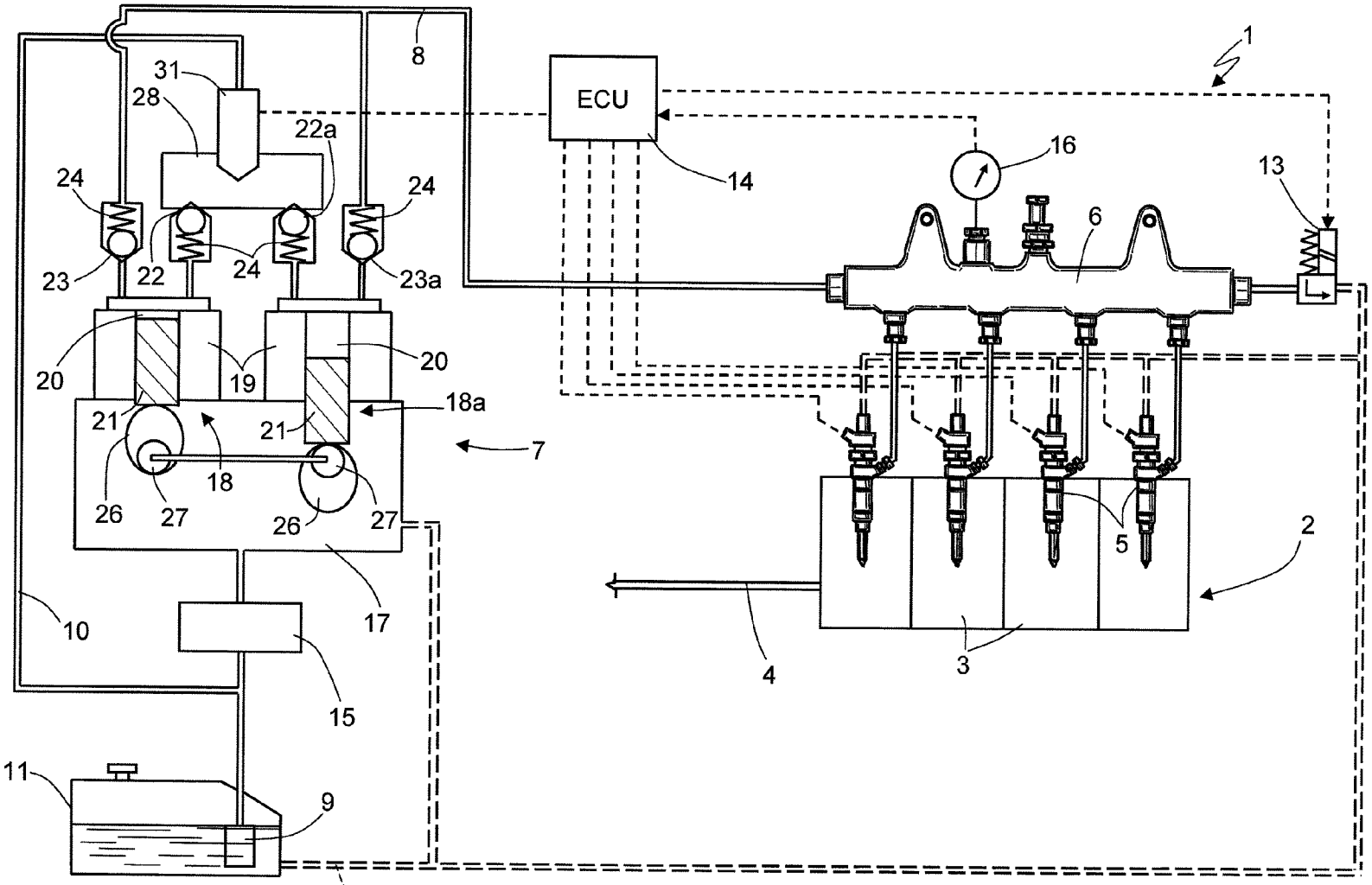
FIG. 1 is a diagram of a fuel-injection system for an internal-combustion engine, comprising a high-pressure pump having a variable flowrate, according to the invention.

With reference to FIG. 1, number 1 designates as a whole a fuel-injection system for an internal-combustion engine 2, for example a four-stroke diesel engine. The engine 2 comprises a plurality of cylinders 3, for example four cylinders, in which corresponding pistons (not shown) slide for turning a driving shaft 4. The injection system 1 comprises a plurality of electrically controlled injectors 5, designed to inject the high-pressure fuel into the corresponding cylinders 3. The injectors 5 are supplied by an accumulation volume for the pressurized fuel, which in the embodiment illustrated, is formed by the usual common rail 6.

The common rail 6 is supplied with high-pressure fuel by a high-pressure pump, designated as a whole by 7, via a delivery pipe 8. In turn, the high-pressure pump 7 is supplied by a low-pressure pump, for example an electric pump 9, via an intake pipe 10 of the pump 7. The electric pump 9 is in general set in the usual fuel tank 11, into which there gives out a pipe 12 for discharge of the fuel in excess of the injection system 1. A part of the fuel of the pipe 10 is sent, via a pressure regulator 15, to a crankcase 17 of the pump 7, for cooling and lubricating the mechanisms thereof, in a way in itself known.

The common rail 6 is moreover provided with a discharge solenoid valve 13 in communication with the discharge pipe 12. Each injector 5 is designed to inject, into the corresponding cylinder 3, a quantity of fuel that varies between a minimum value and a maximum value under the control of an electronic control unit 14, which can be formed by the usual microprocessor electronic control unit (ECU) for controlling the engine 2. The control unit 14 is designed to receive signals indicating the operating conditions of the engine 2, such as the position of the accelerator pedal and the r.p.m. of the driving shaft 4, which are generated by corresponding sensors (not shown), as well as the pressure of the fuel in the common rail 6, detected by a pressure sensor 16.

The control unit 14, by processing the received signals, by means of a purposely provided program controls the instant and duration of the actuation of the individual injectors 5, as well as opening and closing of the discharge solenoid valve 13. Consequently, the discharge pipe 12 conveys into the tank 11 both the discharge fuel of the injectors 5 and the possible fuel in excess in the common rail 6, discharged by the solenoid valve 13, as well as the fuel for cooling and lubrication coming from the crankcase 17 of the pump 7.

The high-pressure pump 7 of FIG. 1 comprises a pair of pumping elements 18 and 18*a*, each formed by a cylinder 19 having a compression chamber 20, in which a piston 21 slides with a reciprocating motion comprising an intake stroke and a delivery stroke. Each pumping element 18, 18*a* is provided with a corresponding intake valve 22, 22*a* and a corresponding delivery valve 23, 23*a*. The valves 22, 22*a* and 23, 23*a* can be of the ball type and can be provided with respective return springs 24. The two intake valves 22, 22*a* are in communication with the intake pipe 10 that is common to both of them, as will be more clearly seen hereinafter, whilst the two delivery valves 23, 23*a* are in communication with the delivery pipe 8 that said valves 23, 23*a* have in common. The two pistons 21 are actuated by corresponding eccentric cams 26 carried by an operating shaft 27 of the pump 7. In the embodiment of FIG. 1, the two pumping elements 18, 18*a* are in line; i.e., they are arranged alongside one another and are actuated by two eccentric cams 26 fitted on the shaft 27 with a phase difference of 180°.

According to the invention, set between the intake pipe 10 and the two intake valves 22, 22*a* is an accumulation volume 28 for the fuel to be taken in, which is provided with two outlet holes 29 and 29*a* (FIGS. 3 and 4), respectively in communication with the corresponding intake valves 22 and 22*a*. The accumulation volume 28 is supplied with the fuel at low pressure of the intake pipe 10, through a solenoid valve 31. The latter is designed to generate a set of jets of fuel, each directed towards at least one of the outlet holes 29, 29*a* of the accumulation volume 28. In the embodiment illustrated, the solenoid valve 31 generates two jets, each directed towards a corresponding outlet hole 29, 29*a* of the accumulation volume 28.

Figure 3:
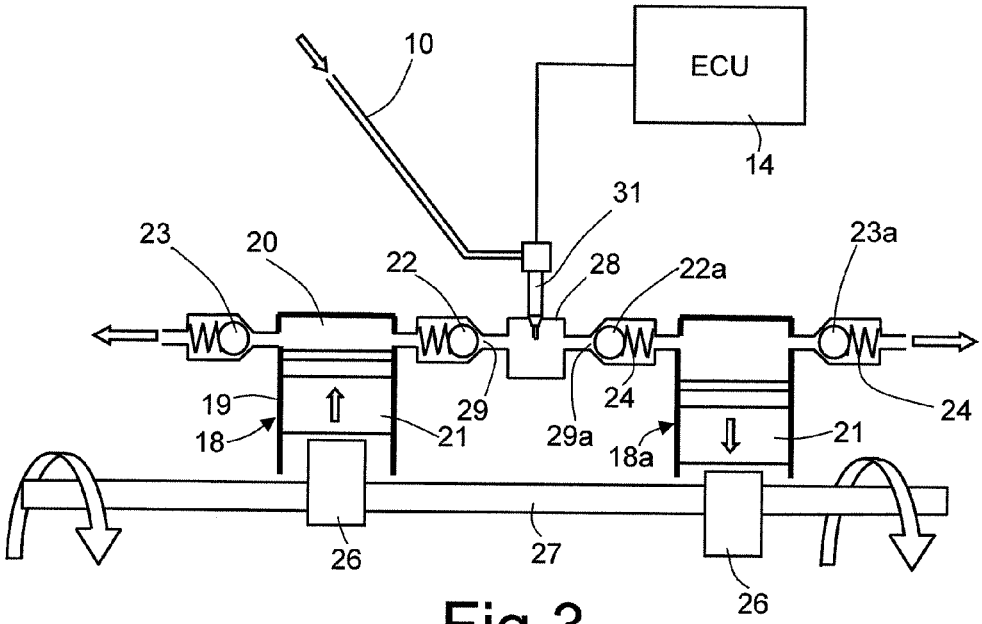
FIG. 3 is a partial diagram of the pump for the system of FIG. 1.

In particular, the solenoid valve 31 is of the on-off type and can be formed by an electromagnetically controlled low-pressure fuel injector (FIG. 4), for example a gasoline injector for Otto-cycle engines. The injector 31 comprises a nozzle 33, terminating with a conical portion 34, in which two diametrally opposed nebulizer holes 36, 36*a* are provided. The holes 36, 36*a* are normally closed by a common open/close element, in the form of a needle 37 having a conical tip 38 designed to engage the internal surface of the conical portion of the nozzle 33. The needle 37 is axially guided by a portion 39 of the nozzle 33 and has a portion 41 having a certain play with a wall 42 of the nozzle 33 to enable passage of the fuel from an injection chamber 43. The needle 37 is controlled so as to open the holes 36, in a known way, by an electromagnet, not indicated in the figure. In FIG. 3, the accumulation volume 28 for the low-pressure fuel is constituted by a short intake pipe set downstream of the injector 31.

In the tank 11 (FIG. 1), the fuel is at atmospheric pressure. In use, the electric pump 9 compresses the fuel to a low pressure, for example in the region of just 2-3 bar. In turn, the injector 31 sends the fuel to the accumulation volume 28, from which it is taken in by means of the intake valves 22, 22*a* of the high-pressure pump 7. This compresses the fuel received and, via the delivery pipe 8, sends the high-pressure fuel, for example in the region of 1600 bar, towards the common rail 6 for the fuel under pressure.

According to the invention, the flowrate of the pump 7 is controlled exclusively by the injector 31, which is designed to be actuated in an asynchronous way with respect to the intake stroke of the pistons 21 of the pumping elements 18 and 18*a*. In particular, the injector 31, by means of the two nebulizer holes 36 and 36*a* (FIGS. 3 and 4), generates two jets of fuel, which are directed towards the outlet holes 29 and 29*a* of the accumulation volume 28, and hence towards the intake valves 22 and 22*a*. In this way, even if the amount of fuel injected by the injector 31 is very small, it acts on the valves 22 and 22*a* with a certain dynamic energy such that the intake valves 22 and 22*a* of the pumping element 18, 18*a* in the intake stroke open immediately in any case, right from the start of the intake stroke of the corresponding piston 21.

Figure 4:
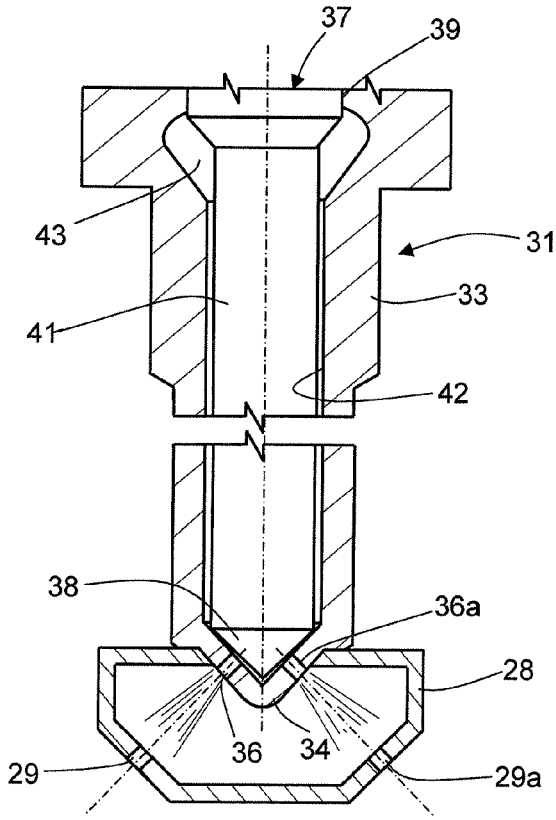
FIG. 4 is a detail of a variant of the supply of the pump, at an enlarged scale.

In particular in FIGS. 3 and 4, the pump 7 is provided with two in line pumping elements 18 and 18*a*, and the accumulation volume 28 is located between the pumping elements 18 and 18*a*. The holes 36 and 36*a* of the injector 31, the outlet holes 29 and 29*a* of the accumulation volume 28 and the intake valves 22 and 22*a* of the pumping elements 18 and 18*a* are provided in positions specular to one another. The nebulizer holes 36 and 36*a* of the solenoid valve 31 and the outlet holes 29 and 29*a* of the accumulation volume 28 are arranged in such a way that the two jets of fuel will form an angle smaller than, or equal to, 180° (in the plane containing the axes of the holes 29, 29*a* and 36, 36*a* themselves) with respect to one another. In the case of FIG. 3, the intake valves 22 and 22*a* and the outlet holes 29 and 29*a* are substantially coaxial.

Figure 2:
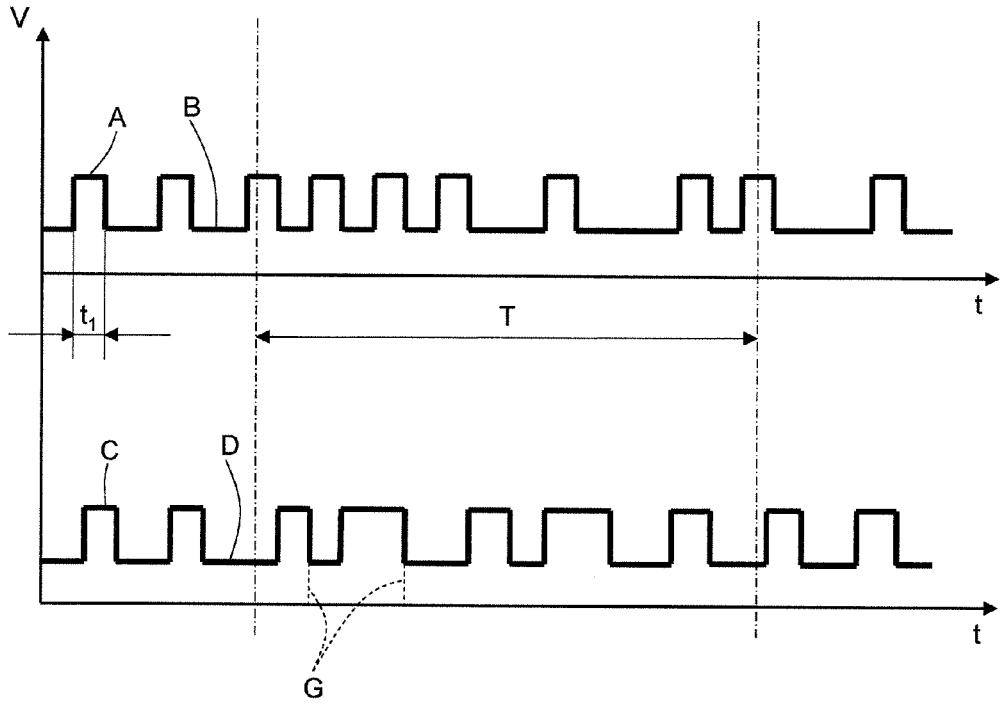
FIG. 2 illustrates two diagrams of the operation of the system of FIG. 1.

The injector 31 (FIG. 1) is controlled by the electronic control unit 14 as a function of the operating conditions of the engine 2 both during the intake stroke and during the compression stroke of the piston 21 of each pumping element 18, 18*a*. The injector 31 is controlled by the control unit 14 by means of control signals modulated in frequency and/or in duty-cycle. Given in FIG. 2 are two diagrams that represent two types of control signals. Said signals can have a duration of the order of one thousandth of a second, whilst the duty-cycle can vary widely between 2% and 95%.

According to a first embodiment of the control unit 14, this latter is designed to control the injector 31 by means of control signals A of constant duration $t_1$, the frequency of which is modulated. Consequently, in order to vary the amount of fuel to be pumped, the time interval B between the signals A is varied. According to another embodiment, the control unit 14 is designed to control the injector 31 by means of control signals C having a constant frequency (and hence, period), the duty-cycle of which is modulated. The constancy of the frequency is indicated in FIG. 2 by the constancy of the distance of the dashed lines G (i.e., by the constancy of the periods). Consequently, the adjustment of the flowrate is obtained by varying the duration C of the signals and the corresponding interval D in such a way that, for any two periods $G1=C1+D1$ and $G2=C2+D2$, it is always $G1=G2$, with $C1 \neq C2$ and $D1 \neq D2$. It is obviously possible to control the injector 31 by modulating both the frequency of the signals and the corresponding duty-cycle. The frequency of opening of the injector 31 is correlated to the speed of rotation of the pump 7.

The nebulizer holes 36 and 36*a* of the injector 31 have an outlet section, i.e., a section of effective passage, which is relatively small so as to enable the fuel metering before it is brought up to a high pressure by the pump 7. Preferably, said section of passage is such that, with the control at the maximum frequency or at the maximum duty-cycle of the control signal, the injector 31 will present a maximum instantaneous flowrate higher than the maximum instantaneous flowrate that can be taken in by each intake valve 22, 22*a*, said maximum flowrate being defined by the product of the maximum speed of the pumping element and the bore thereof. The maximum instantaneous flowrate of the injector 31 is chosen so as to be up to 20% more than the maximum instantaneous flowrate of each intake valve 22, 22*a*.

Advantageously, the section of passage of the nebulizer holes 36, 36*a* of the injector 31 is also such as to create a mean flowrate, during a pre-set time interval T, which is greater than the mean flowrate of fuel taken in through each intake valve 22, 22*a*. In FIG. 2, said time interval T is indicated by two dashed-and-dotted lines and comprises a plurality of signals A and C. Said time interval can be of the same order of magnitude as the duration of the intake stroke of the piston 21 of each pumping element 18, 18*a*. Obviously, the number of signals A and C given in FIG. 2 in the time interval T is purely indicative.

From the tests carried out, it has been found that the adjustment of the flowrate of the pump 7 enables an accurate metering of the fuel pumped upon actuation of each injector 5 via modulation of opening of the injector 31 controlled by the control unit 14. In this way, the volume of the common rail 6 of the high-pressure fuel can be enormously reduced. It has moreover been found that, if the jets of fuel are directed, through the nebulizer holes 36, 36*a*, towards the corresponding intake valves 22, 22*a*, the phenomenon of cross talk of pressure between the two valves 22, 22*a* is prevented even in conditions of minimum requirement of fuel.

Figure 5:
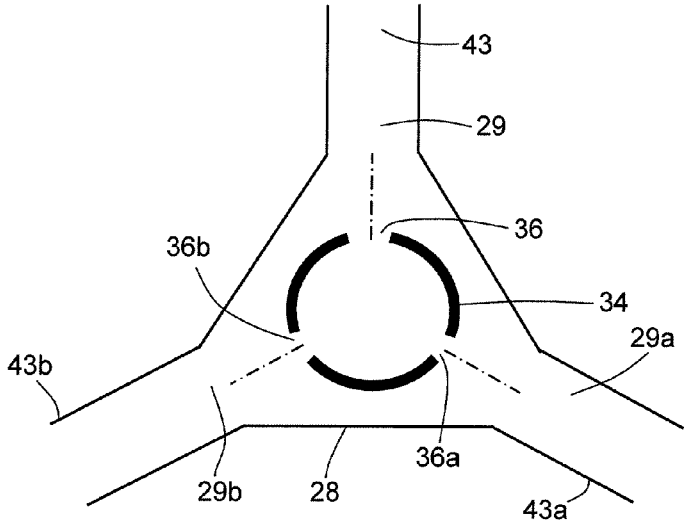
FIG. 5 is a diagram of a detail of the supply of a pump with three pumping elements.

According to a variant (not illustrated), the high-pressure pump 7 can be provided with three pumping elements 18 arranged in a star configuration and actuated by a common eccentric cam. In this case, the accumulation volume 28 (FIG. 5) can have a prismatic shape, a cylindrical shape, or else be shaped like a spherical cap and is set substantially coaxial with the usual axis of rotation of the eccentric cam. The accumulation volume 28 has three outlet holes 29, 29*a*, 29*b*, arranged at 120° with respect to one another and in communication with the intake valves 22 of the three pumping elements 18, through corresponding pipes 43, 43*a*, 43*b*, made in the usual crankcase of the pump 7. The injector 31 is set with the conical portion 34 inserted in the accumulation volume 28 and has three nebulizer holes 36, 36*a*, 36*b* arranged at 120° with respect to one another and set so as to direct the corresponding jets of fuel at low pressure onto the three corresponding outlet holes 29, 29*a*, 29*b* so that the three jets form an angle of 120° with respect to one another.

According to another variant of the invention, the pump 7 can be formed by four pumping elements 18, and the accumulation volume 28 can have four corresponding outlet holes 29, whilst the injector 31 is designed to generate four jets of fuel directed towards said outlet holes. The four pumping elements 18 can be grouped into two sets, possibly arranged at an angle between one another, with respect to the shaft 27 of the pump 7. In this case, actuation of the pumping elements 18 is phased in such a way that the intake stroke of a pumping element 18 of one set alternates with that of a pumping element 18 of the other set. The injector 31 can then be provided only with just two nebulizer holes 36, 36*a*, as in FIG. 4, in such a way that each jet is directed towards the two intake valves of a corresponding set of pumping elements 18.

From what has been seen above the advantages of the injection system according to the invention with respect to the known art emerge clearly. In particular, the fuel metering is advantageously made by the injector 31 on fuel at low pressure, instead of by the pumping elements 18. Consequently, having sized appropriately the accumulation volume 28, i.e., with a value similar to that of the minimum volume of fuel required, even in the conditions of minimum flowrate required by the engine, in the volume 28 a pressure sufficient to enable opening of the valves 22 and 22*a* will always be obtained. With the asynchronous control of the injector 31, the need for constraining actuation of the injector 31 to the position of the piston 21 for control of metering is eliminated. In addition, the injector 31 is controlled at a frequency independent of the frequency of the intake strokes of the pump 7. Finally, since the injector 31 is of the on-off type, it is simpler than the proportional solenoid valves used in known systems so that the system according to the invention presents a very contained cost.

It is understood that various modifications and improvements can be made to the injection system having the high-pressure pump and the regulation device described above without departing from the scope of the ensuing claims. For example, it is possible to eliminate the usual motion transmission device between the driving shaft 4 and the shaft 27 of the high-pressure pump 7, which can thus be turned at a rate independent of that of the driving shaft 4. Also the solenoid discharge valve 13 of the fuel from the common rail 6 can be eliminated.

The invention claimed is:

1. A fuel-injection system for an internal-combustion engine, comprising a high-pressure pump (7) with variable flowrate, having a number of pumping elements (18) actuated with reciprocating motion through intake and delivery strokes, each of said pumping elements (18) being provided with a corresponding intake valve (22); said system being characterized in that a volume for accumulation (28) of fuel at low pressure is supplied by an intake pipe (10) of said pump (7) through a solenoid valve (31), said accumulation volume (28) being in communication with said intake valves (22) through corresponding outlet holes (29), said solenoid valve (31) being such as to generate corresponding jets of fuel, each directed towards at least one of said outlet holes (29).

2. The injection system according to claim 1, characterized in that each of said jets of fuel is generated by a corresponding nebulizer hole (36) of said solenoid valve (31).

3. The injection system according to claim 1, characterized in that said solenoid valve (31) is constituted by an electromagnetic-control injector (32) for injection of fuel at low pressure.

4. The injection system according to claim 2, in which said pump (7) is provided with a number of pumping elements (18) set in line, said system being characterized in that said solenoid valve (31) has an equal number of nebulizer holes (36) for generating said jets, each jet being directed towards the corresponding outlet hole (29) of said accumulation volume (28).

5. The injection system according to claim 4, in which said pump (7) is provided with two pumping elements (18, 18*a*), said system being characterized in that said solenoid valve (31) has two nebulizer holes (36), said accumulation volume (28) being set between said pumping elements (18) and having two outlet holes (29), said intake valves (22) and said outlet holes (29) being arranged in positions specular to one another.

6. The injection system according to claim 5, characterized in that the nebulizer holes (36) of said solenoid valve (36) and said outlet holes (29) are arranged in such a way that said jets form an angle smaller than 180° with respect to one another.

7. The injection system according to claim 5, characterized in that said intake valves (22) and said outlet holes (36) are substantially coaxial, said jets being directed at 180° with respect to one another.

8. The injection system according to claim 4, in which said pump (7) is provided with three pumping elements (18) arranged in a star configuration and actuated by a common eccentric cam, said system being characterized in that said accumulation volume (28) is substantially coaxial with the usual rotation axis of said eccentric cam and is in communication with the intake valves of said pumping elements through corresponding pipes.

9. The injection system according to claim 8, characterized in that the nebulizer holes (36) of said solenoid valve (31) and said outlet holes (29) are arranged in such a way that said jets form an angle smaller than 120° with respect to one another.

10. The injection system according to claim 4, in which said pump (7) is provided with four pumping elements (18), said system being characterized in that said solenoid valve (31) is provided with four nebulizer holes (36) and said accumulation volume (28) is provided with four corresponding outlet holes (29), said nebulizer holes (36) and said outlet holes (29) being arranged in such a way that said jets are directed each towards the corresponding outlet holes (29).

11. The injection system according to claim 4, in which said pump (7) is provided with four pumping elements (18) divided into two sets each formed by two pumping elements (18), said system being characterized in that, for each pumping element (18), said accumulation volume (28) is provided with a corresponding outlet hole (29), said solenoid valve (31) being provided with a nebulizer hole (36) for each of said sets of pumping elements (18), said nebulizer holes (36) being arranged so as to generate each a corresponding jet of fuel directed towards the outlet holes (29) of said accumulation volume (28) of the corresponding set of pumping elements (18).

12. The injection system according to any one of the preceding claims, characterized in that said solenoid valve (31) is controlled asynchronously with respect to said intake strokes as a function of the operating conditions of the engine by a control unit (14), by means of control signals (A, C) modulated in frequency and/or in duty-cycle as a function of the operating conditions of the engine (2).

13. The injection system according to claim 12, characterized in that said control unit (14) is designed to control said solenoid valve (31) by means of control signals having a frequency correlated to the speed of rotation of said pump and/or having a variable duty-cycle.

14. The injection system according to claim 13, characterized in that said control unit (14) is designed to control said solenoid valve (31) by means of control signals (A) of constant duration, said control signals (A) being emitted with variable frequency.

15. The injection system according to claim 14, characterized in that said frequency is lower than the maximum frequency of the intake strokes of said pump (7).

16. The injection system according to claim 12, characterized in that the maximum instantaneous flowrate of fuel through said solenoid valve (31) can be up to 20% more than the maximum instantaneous flowrate of fuel taken in through each of said intake valves (22).

17. The injection system according to claim 16, characterized in that the outlet section of said solenoid valve (31) is such as to deliver a flowrate higher than the mean flowrate of fuel taken in through said intake valves (22).

18. The injection system according to claim 12, characterized in that the duration of each control signal (A, C) is of the order of one thousandth of a second and/or said duty-cycle varies from 2% to 95%.

* * * * *